United States Patent [19]

Hornung et al.

[11] 4,356,745

[45] Nov. 2, 1982

[54] SYNCHRONOUS ROTARY CROSS CUTTER

[75] Inventors: Hans Hornung, Alsbach; Wolfgang Schneider, Pfungstadt, both of Fed. Rep. of Germany

[73] Assignees: Dr. Otto C. Strecker KG, Pfungstadt; Bruderhaus Maschinen GmbH, Reutlingen, both of Fed. Rep. of Germany

[21] Appl. No.: 202,056

[22] Filed: Oct. 30, 1980

[30] Foreign Application Priority Data

Nov. 12, 1979 [DE] Fed. Rep. of Germany ..... 2945669

[51] Int. Cl.[3] ..... B26D 1/62

[52] U.S. Cl. ..... 83/341; 83/342; 83/348

[58] Field of Search ..... 83/342, 341, 348

[56] References Cited

U.S. PATENT DOCUMENTS

| | | | |
|---|---|---|---|
| 1,398,474 | 11/1921 | Strawn | 83/348 X |
| 2,153,013 | 4/1939 | Ungar | 83/341 |
| 2,478,240 | 8/1949 | Christman | 83/341 |
| 3,068,731 | 12/1962 | Schultz et al. | 83/342 X |
| 3,084,582 | 4/1963 | Anderson | 83/348 X |
| 3,247,746 | 4/1966 | Nystrand | 83/342 |
| 3,570,348 | 3/1971 | Hallden | 83/342 |
| 3,709,077 | 1/1973 | Trogan et al. | 83/342 X |
| 4,034,637 | 7/1977 | Ollery | 83/341 |

*Primary Examiner*—Frank T. Yost

*Attorney, Agent, or Firm*—Michael J. Striker

[57] ABSTRACT

A synchronous rotary cross cutter for cutting a material web of paper or the like has two drums which synchronously rotate about parallel axes at opposite sides of the material web, and a cutting element on each drum. One of the cutting elements is elastically yieldable, and the drum for this cutting element has a helical bearing surface with an axis lying on the cutting edge of the elastically yieldable cutting element. The helical surface of the drum has such an inclination that the free angles of the elastically yieldable cutting element at the beginning and at the end of the cutting line are identical.

6 Claims, 4 Drawing Figures

SYNCHRONOUS ROTARY CROSS CUTTER

BACKGROUND OF THE INVENTION

The present invention relates to a synchronous rotary cross cutter for cutting a material web of paper and the like.

More particularly, it relates to a synchronous cross cutter which includes two drums located at opposite sides of the path of the material web and synchronously rotatable about parallel axes, wherein each drum is provided with axially extending cutting elements arranged on the periphery of the drum, from which one of the cutting elements is formed or mounted elastically yieldably, and the cutting element of this pair is arranged with a certain two-sided overlap and produces at its one side a pulling cut in the plane of the path of the material web.

Rotary cross cutters of the above-mentioned general type are known in the art. In a known rotary cross cutter, the point of mutual contact of cross cutting elements moves during each cutting operation from one side of the material web to the other side of the latter, transversely to the longitudinal direction of the material web. In other words, the point of mutual contact travels from one side of the cutting element to the other side thereof. The cutting edges of the cutting elements do not extend parallel to the axes of the drums. Instead, they are turned at their periphery and produce thereby a shearing cut. The drums must rotate by a certain angle until the cut is carried out over the entire working width. During the cutting operation the cutting edges of the cutting elements lie on the contact point which moves transversely to the path of the material web, under pressure with spring action. However, during travelling of the angle of rotation, the geometrical position of the cutting elements relative to one another is changed. Thereby, the quality of cutting is also changed. This is especially disadvantageous for the cutting element which is formed or mounted in the drum elastically yieldable, since its free angle increases and thereby there is a tendency that it will be rigidly superimposed on the counter cutting element. This tendency increases with the wear of the cutting edge and can lead to breakage of portions of the cutting edges, and thereby to failure.

SUMMARY OF THE INVENTION

Accordingly, it is an object of the present invention to provide a synchronous rotary cross cutter which avoids the disadvantages of the prior art.

More particularly, it is an object of the present invention to provide a synchronous rotary cross cutter in which cutting elements are arranged so that the above-mentioned danger of damage and destruction is eliminated, without changing the geometry of the cutting edges on which the cutting quality depends.

In accordance with experiments based upon theoretical considerations, in conditions when the angles determining the cutting geometry always have small absolute and changing amounts, the solution of the above-mentioned problem was found in that a drum carrying an elastically yieldable cutting element is provided with a bearing surface which is formed as a helical surface with an axis lying on a cutting edge of these cutting elements, whereas the direction of rotation and the inclination of the helical surface are so selected that a free angle $\alpha$ of this cutting element is identical at the beginning and at the end of a cutting line.

The bearing surface of the elastically yieldable cutting element is no longer formed as a plane which is somewhat twisted toward the drum axis, but instead is formed as a helical surface characterized in that the axis of this helical surface is straight and coincides with the cutting edge of the cutting element. The predetermined helical shape of the cutting element surface compensates for the change of the free angle which is controlled by changing position of the cutting element relative to the path of the web material, without changing the geometry of the cutting edges inside the entire arrangement.

The cutting point, that is the instantaneous point of contact of the upper and lower cutting elements, travels from one edge to the other edge of the material web in condition of constant rotational speed of the drums not with a constant speed. Instead, it travels from the beginning to the end with deceleration. When in accordance with the invention the bearing surface is formed as a helical surface with constant inclination, the free angle of the elastically yieldable cutting element can be identical only in two points of the cutting line, for example in the beginning of the cutting line and in the end of the latter. However, according to a further advantageous feature of the invention, the inclination of the helical surface along the drum axis may gradually decrease in correspondence with the reducing travelling speed of the cutting point, so that the free angle remains constant over the entire cutting line.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF A PREFERRED EMBODIMENT

Figure 1:
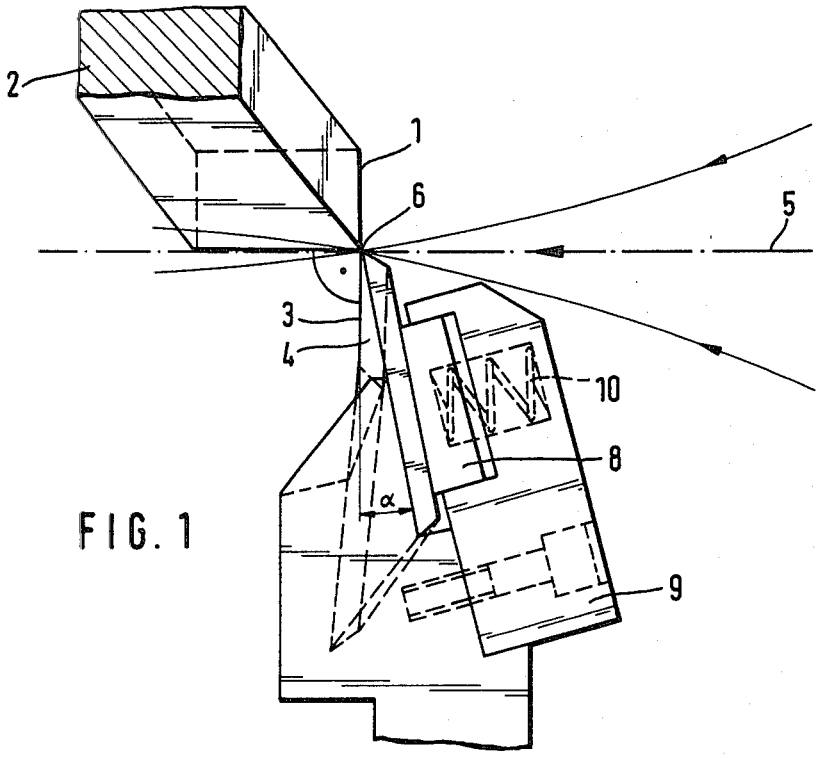
FIG. 1 is a view showing two cutting elements of a synchronous rotary cross cutter in accordance with the present invention, in the beginning of a cutting operation.

A synchronous rotary cross cutter in accordance with the present invention has an upper cutting element 2 with a cutting edge 1 and a lower cutting element 4 with a cutting edge 3. A material web 5 is to be cut by the thus illustrated cutter. The movements of the upper cutter element 2 and the lower cutter element 4 and the travelling direction of the material web 5 during cutting are identified by arrows.

When the cutting edges 1 and 3 of the cutting elements 2 and 4 first come into engagement with each other in the beginning of the cutting operation, the contours of the left ends of the cutting elements (as considered in the travelling direction of the material web 5) assume relative to the material web 5 a position which is shown in FIG. 1. The angle between the lower cutting element 4 and the perpendicular to the material web 5 is a free angle $\alpha$.

Figure 2:
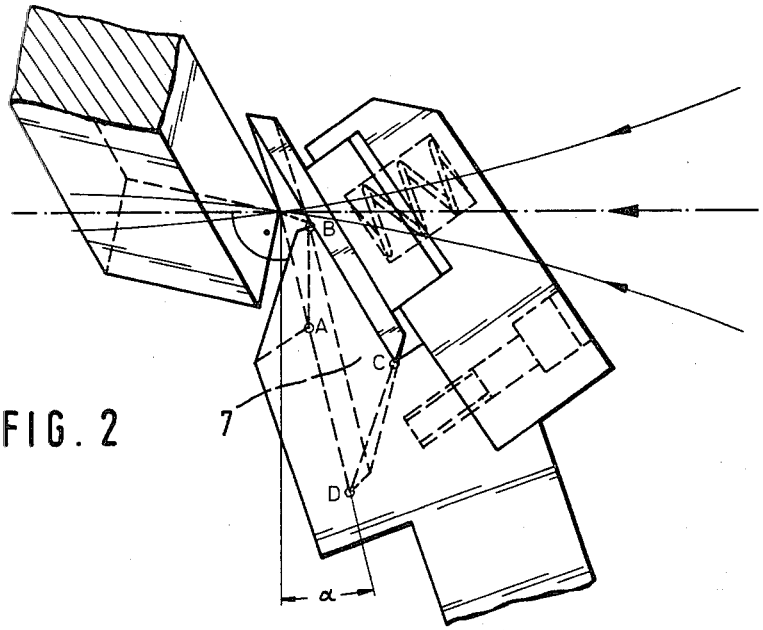
FIG. 2 is a view showing two cutting elements in the end of the cutting operation.

In the course of the further rotary movement of the drums carrying the cutting elements 2 and 4 in direction of the arrow, a contact point 6 of the cutting edges 1 and 3 travels in the material web 5 along the cutting line to the end of the cutting elements 2 and 4 toward the right side of the machine. The free angle $\alpha$ has here the same value as in the beginning of the cutting operation, inasmuch as the lower cutting element 4 is somewhat twisted along the axis of the drum. This is attained by provision of a helically shaped bearing surface 7 for the lower cutting element 4. In order to more clearly illustrate the bearing surface 7, it is identified in FIG. 2 in its corner points by reference letters A, B, C and D. The axis of the helical surface lies on the cutting edge 3 of the lower cutting element 4.

The lower cutting element 4 is pressed against the bearing surface 7 by a member 8 which is guided in a tightening plate 9 and is arranged under the pressure of a helical spring 10, as can be clearly seen from FIG. 1.

Figure 3:
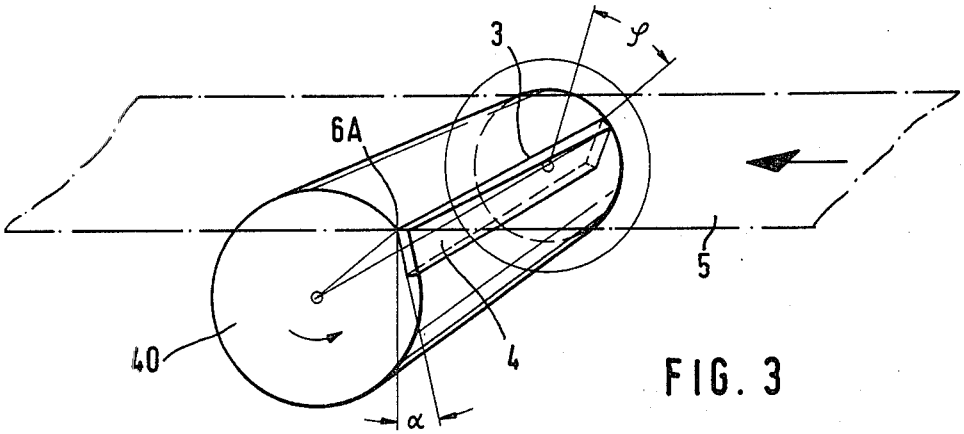
FIG. 3 is a reduced perspective view showing an elastically yieldable cutting element arranged in a lower cutting drum.

FIG. 3 shows a perspective view of a lower drum 40 with the lower cutting element 4, and the material web 5. The free angle $\alpha$ is shown in the beginning of the cut 6*a* and the drum angle of rotation $\phi$ is shown from the beginning of the cut to the end of the cut. It can be seen from this Figure how the surface of the lower cutting element 4 is twisted helically, whereas its cutting edge 3 is straight. The straight cutting edge 3 is an axis of the helical surface inside which the cutting surface lies.

Figure 4:
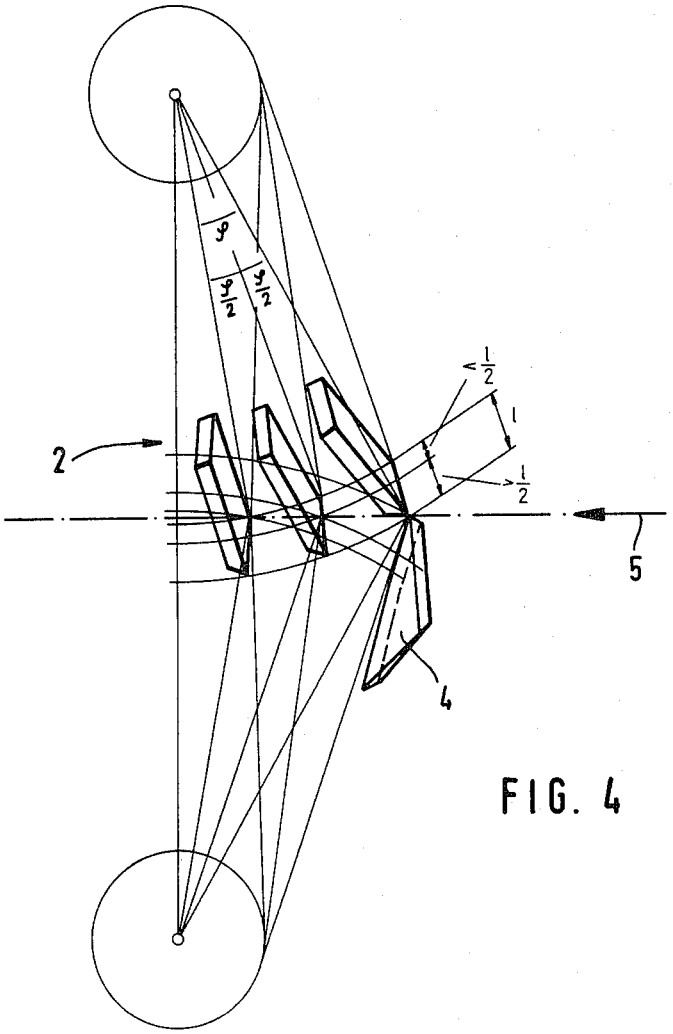
FIG. 4 is a reduced perspective view showing the positions of an upper rigid cutting element in the beginning, in the middle, and in the end of the cutting process.

FIG. 4 shows the upper cutting element 2 in three positions from the beginning to the end of the cut spaced from each other by the half angle of rotation $\phi/2$. It can be seen that the cutting speed, or in other words the travelling speed of the cutting point 6 along the cutting line, is not constant. In the central position of the upper cutting element 2, more than half the width of the material web 5 is cut. Since the travelling speed of the cutting point is somewhat higher in the beginning of the cut than in the end of the latter, it is advantageous to provide such an inclination of the bearing surface 7 (FIG. 2) for the elastically yieldable lower cutting element 4 that the inclination changes gradually in a manner ensuring that the free angle $\alpha$ remains constant over the entire cutting operation.

It will be understood that each of the elements described above, or two or more together, may also find a useful application in other types of constructions differing from the types described above.

While the invention has been illustrated and described as embodied in a synchronous rotary cross cutter, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A synchronous rotary cross cutter for cutting a material web of paper and the like travelling in a predetermined path, the cutter comprising two drums arranged at opposite sides of the path of the material web and synchronously rotatable about parallel axes, each of said drums having a peripheral surface; and at least two cutting elements each arranged on said peripheral surface of a respective one of said drums so as to extend in an axial direction of the latter and having cutting edges engaging one another, one of said cutting elements being arranged elastically yieldably with a two-sided overlap and producing at its one side a pulling cut which starts in a plane of the path of the material web and extends over a cutting line, one of said drums which carries said elastically yieldable cutting element having a bearing surface provided for the latter and formed as a helical surface, said helical surface having an axis which lies on the cutting edge of said elastically yieldable cutting element, said helical surface having such an inclination that free angles of said elastically yieldable cutting element at the beginning and at the end of said cutting line are equal to one another.

2. A cutter as defined in claim 1, wherein said elastically yieldably arranged cutting element is formed so as to render elastically yieldable.

3. A cutter as defined in claim 1, wherein said elastically yieldably arranged cutting element is mounted on a respective one of said drums so as to render elastically yieldable.

4. A cutter as defined in claim 1, wherein said cutting edges of said cutting elements engage one another in a cutting point which displaces with a reducing speed, said inclination of said helical surface gradually increasing in an axial direction of said one drum in correspondence with said reducing speed so as to insure that said free angle remains constant over the entire cutting line.

5. A cutter as defined in claim 1, wherein said cutting edge of said elastically yieldable cutting element has a radial distance to the axis of the respective drum, which decreases from one end to the opposite end of said cutting edge.

6. A synchronous rotary cross cutter for cutting a material web of paper and the like travelling in a predetermined path, the cutter comprising two drums arranged at opposite sides of the path of the material web and synchronously rotatable about parallel axes, each of said drums having a peripheral surface; and at least two cutting elements each arranged on said peripheral surface of a respective one of said drums so as to extend in an axial direction of the latter and having cutting edges engaging one another and arranged so that a radial distance from each cutting edge to the axis of the respective drum decreases from one end to the opposite end of said cutting edge, one of said cutting elements being arranged elastically yieldably with a two-sided overlap and producing at its one side a pulling cut which starts in a plane of the path of the material web and extends over a cutting line, one of said drums which carries said elastically yieldable cutting element having a bearing surface provided for the latter and formed as a helical surface, said helical surface having an axis which lies on the cutting edge of said elastically yieldable cutting element, said helical surface having such an inclination that free angles of said elastically elastically yieldable cutting element at the beginning and at the end of said cutting line are equal to one another.

* * * * *